US007748821B2

(12) United States Patent
Nakashima

(10) Patent No.: US 7,748,821 B2
(45) Date of Patent: Jul. 6, 2010

(54) INK-JET PRINTER

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 801 days.

(21) Appl. No.: 11/678,666

(22) Filed: Feb. 26, 2007

(65) Prior Publication Data

US 2007/0200893 A1 Aug. 30, 2007

(30) Foreign Application Priority Data

Feb. 24, 2006 (JP) ..... 2006-047728

(51) Int. Cl.
*B41J 2/165* (2006.01)

(52) U.S. Cl. ..... 347/33; 347/29; 347/34

(58) Field of Classification Search ..... 347/29, 347/33, 34

See application file for complete search history.

(56) References Cited

U.S. PATENT DOCUMENTS 5,608,432 A 3/1997 Yamaguchi
7,311,377 B2 12/2007 Takagi
7,614,721 B2 * 11/2009 Ito et al. ..... 347/33

FOREIGN PATENT DOCUMENTS

JP H05-162320 A 6/1993
JP H-6171104 6/1994
JP H-6226985 8/1994
JP H-7164642 6/1995
JP 200171519 3/2001
JP 2003-266715 A 9/2003
JP 2005-096340 A 4/2005
JP 2005-199597 A 7/2005

OTHER PUBLICATIONS

Japan Patent Office; Notice of Reasons for Rejection in Japanese Patent Application No. 2006-047728 (counterpart to the above-captioned U.S. patent application) mailed Sep. 8, 2009.

* cited by examiner

*Primary Examiner*—Julian D Huffman
*Assistant Examiner*—Jason S Uhlenhake
(74) *Attorney, Agent, or Firm*—Baker Botts, LLP.

(57) ABSTRACT

An object of the present invention is to provide an ink-jet printer that can wipe off ink adhering to an ink ejection face and besides can clean a lip of a cap in such a manner that foreign materials adhering to the lip can surely be removed. An ink-jet printer includes a cap, a wiper, a cap cleaning blade, and an ink supplier. The cap is contactable with and separable from an ink ejection face of an ink-jet head, and includes a lip that is brought into close contact with the ink ejection face. The wiper is movable in parallel to and relative to the ink ejection face. The cap cleaning blade is provided integrally with the wiper, and, while being in contact with the lip, cleans the lip in association with the wiper moving relative to the ink ejection face. The ink supplier supplies ink wiped off by the wiper to the cap cleaning blade.

10 Claims, 14 Drawing Sheets

INK-JET PRINTER

BACKGROUND OF THE INVENTION

1. Field of the Invention

The present invention relates to an ink-jet printer that performs recording by ejecting ink to a recording medium.

2. Description of the Related Art

An ink-jet printer is configured to, while conveying a recording medium such as a recording paper, eject ink from nozzles of an ink-jet head to the recording medium thereby recording a desired character, image, or the like on the recording medium. A conventional ink-jet printer includes a cap that covers a face (hereinafter referred to as an ink ejection face) on which ejection ports of nozzles are arranged, in order to prevent ink in the nozzles from drying up while an ink-jet head is not in use or in order to perform nozzle purge for eliminating clogging of the nozzles. In general, moreover, the ink-jet printer also includes a wiper that wipes off extra ink adhering to the ink ejection face after recording an image or alternatively after performing the purge operation, to thereby keep good ejection of ink from the nozzles.

Foreign materials such as dust, paper powder and the like may sometimes adhere to a portion of the cap referred to as lip which will be brought into close contact with the ink ejection face. If the ink ejection face is capped by the lip with adhering foreign materials, the foreign materials on the lip may undesirably adhere to the ink ejection face. As a result, failure of ejection may be caused by entry of the foreign materials into the ejection ports of the nozzles, or damage to the ink ejection face may be caused when the wiper wipes ink off the ink ejection face. Therefore, an ink-jet printer adapted to clean a lip of a cap for removing foreign materials therefrom has been proposed.

For example, there is known an ink-jet printer including a wiper blade that cleans an ink ejection face and a cap cleaner that cleans a cap. Both of the wiper blade and the cap cleaner are mounted on a holder that is movable in parallel to the ink ejection face. When the cap is spaced from the ink ejection face, the holder moves between the cap and the ink ejection face, so that the wiper blade wipes ink off the ink ejection face while the cap cleaner cleans the cap.

However, while an ink-jet head is in use, the cap is dry because it is left spaced from the ink ejection face. Accordingly, when the cap cleaner cleans the cap, high resistance is caused therebetween. Thus, it is more likely that vibration occurs, which may hinder sufficient removal of foreign materials adhering to the cap.

SUMMARY OF THE INVENTION

An object of the present invention is to provide an ink-jet printer that can wipe off ink adhering to an ink ejection face and besides can clean a lip of a cap in such a manner that foreign materials adhering to the lip can surely be removed.

According to an aspect of the present invention, there is provided an ink-jet printer comprising an ink-jet head, a cap, a wiper, a cap cleaner, and an ink supplier. The ink-jet head ejects ink. The cap is contactable with and separable from an ink ejection face of the ink-jet head, and includes a lip brought into close contact with the ink ejection face. The wiper is movable in parallel to and relative to the ink ejection face, and wipes off ink adhering to the ink ejection face. The cap cleaner is provided integrally with the wiper, and, while being in contact with the lip, cleans the lip in association with the wiper moving relative to the ink ejection face. The ink supplier supplies ink wiped off by the wiper to the cap cleaner.

In the above ink-jet printer, ink adhering to the ink ejection face is wiped off by the wiper, and the ink thus wiped off is supplied to the cap cleaner by the ink supplier. Thus, the cap cleaner cleans the lip of the cap while wetting the lip with the ink. Therefore, foreign materials such as dust and paper powder adhering to the lip can be removed reliably.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
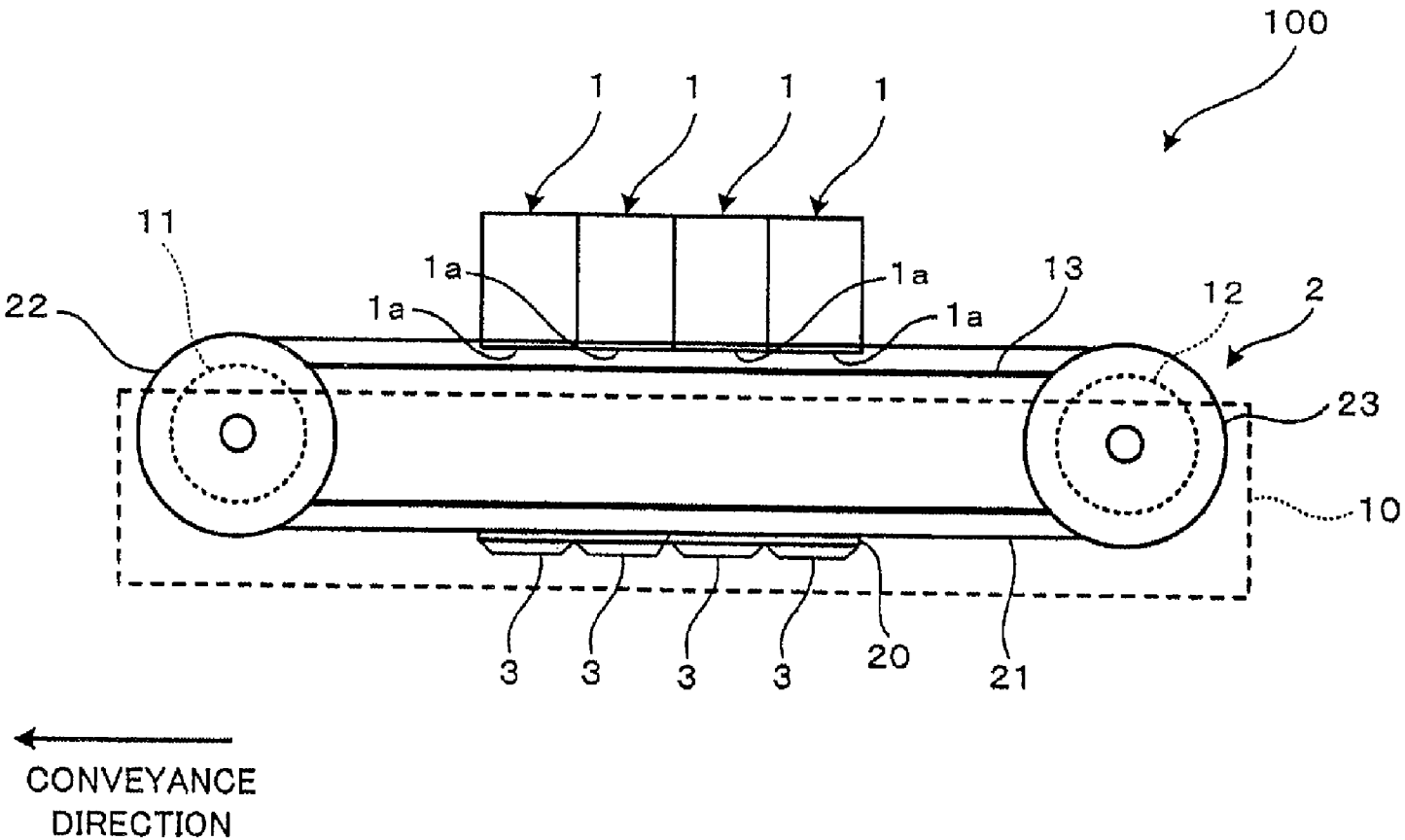
FIG. 1 schematically illustrates an ink-jet printer according to an embodiment of the present invention, while recording is performed.

Next, an embodiment of the present invention will be described. FIG. 1 shows a schematic construction of an ink-jet printer 100 according to an embodiment of the present invention, while recording is performed. As shown in FIG. 1, the ink-jet printer 100 of this embodiment includes four ink-jet heads 1, a conveyor mechanism 2, four caps 3, and a cleaning unit 4 (see FIG. 5). The four ink-jet heads 1 eject ink to a recording paper thus recording thereon a desired character, image, or the like. The conveyor mechanism 2 conveys a recording paper in a horizontal direction in FIG. 1. The four caps 3 cover respective lower faces (ink ejection faces 1*a*) of the four ink-jet heads 1, while the ink-jet head 1 is not in use. The cleaning unit 4 includes a wiper 31 that wipes off ink adhering to the ink ejection faces of the ink-jet head 1.

Figure 2:
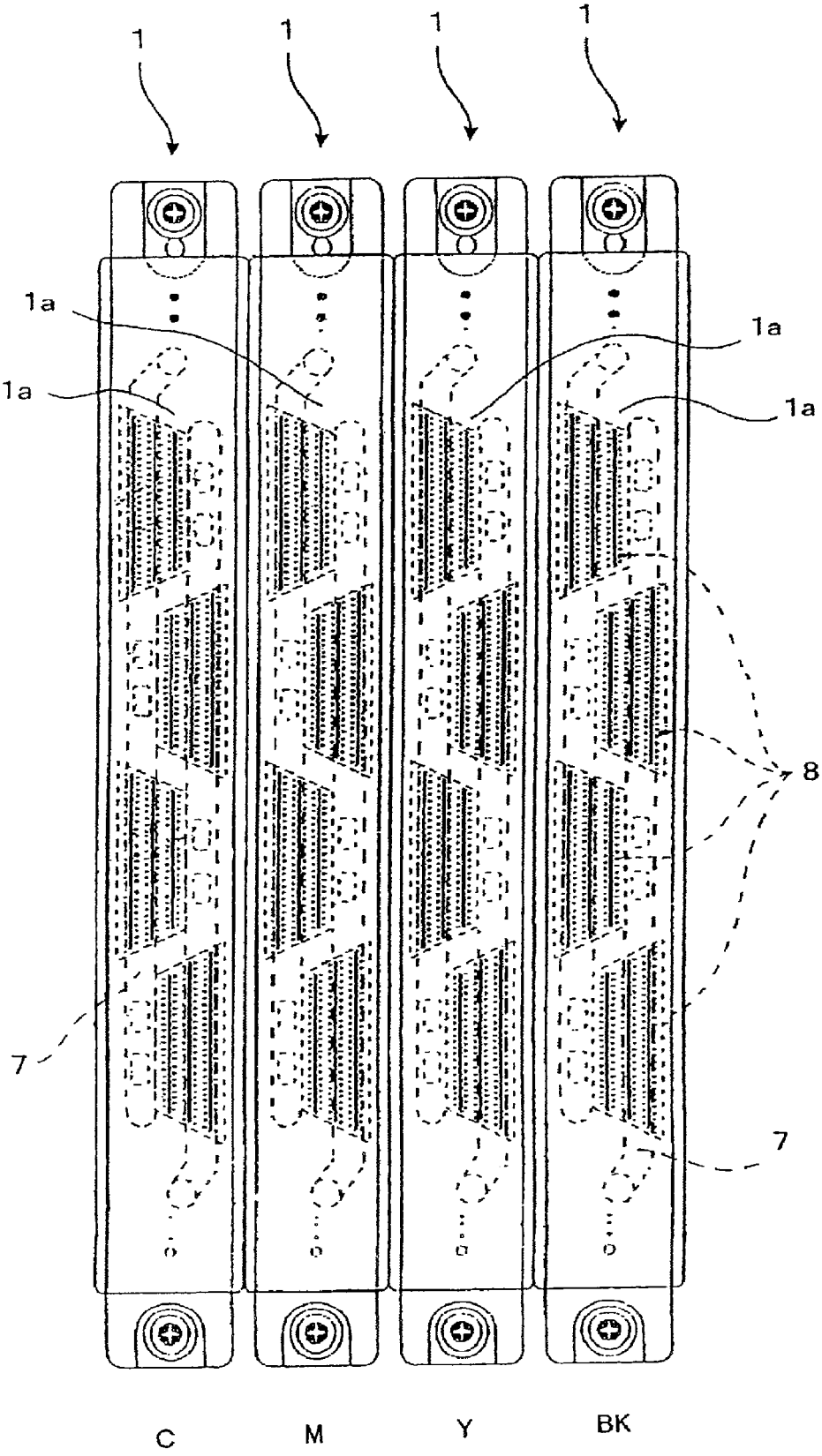
FIG. 2 is a plan view of four ink-jet heads illustrated in FIG. 1, as seen from an ink ejection face side.

First, the ink-jet head 1 and the conveyor mechanism 2 will be briefly described. As shown in FIGS. 1 and 2, the ink-jet head 1 is a line-type ink-jet head extending in a direction perpendicular to a recording paper conveyance direction (i.e., in a direction perpendicularly crossing the drawing sheet of FIG. 1 or an up-and-down direction in FIG. 2). Four ink-jet heads 1 are disposed sequentially in the recording paper conveyance direction. The four ink-jet heads 1 eject four kinds of ink, that is, cyan ink (C), magenta ink (M), yellow ink (Y), and black ink (BK).

As shown in FIG. 2, formed in each ink-jet head 1 are ink passages including manifold channels 7 to which ink is supplied and nozzles 8 communicating with the manifold channels 7. A lower face of each ink-jet head 1 functions as an ink ejection face 1*a* on which ejection ports of the nozzles 8 are arranged in a longitudinal direction of the head (up-and-down direction in FIG. 2). An unillustrated actuator applies pressure to ink in the ink passages, so that ink is ejected through the respective nozzles 8.

As shown in FIG. 1, the conveyance mechanism 2 includes a drive roller 11, a slave roller 12, and an endless conveyor belt 13. The drive roller 11 and the slave roller 12 are rotatably provided on the conveyance frame 10. The endless belt 13 is stretched between the two rollers 11 and 12. A recording paper is held on an outer surface (conveyor face) of the conveyor belt 13. A narrow space is ensured between the conveyor face of the conveyor belt 13 and the ink ejection faces 1*a* of the ink-jet heads 1. While a recording paper held on the conveyor face is conveyed leftward in FIG. 1 by the conveyor belt 13 along with rotation of the two rollers 11 and 12, the ink-jet heads 1 disposed on an upper side eject ink to the recording paper being conveyed. The conveyance frame 10 having the two rollers 11, 12 and the conveyor belt 13 provided thereon is adapted to be driven by an unillustrated elevator mechanism in an up-and-down direction relative to the four ink-jet heads 1.

Figure 3:
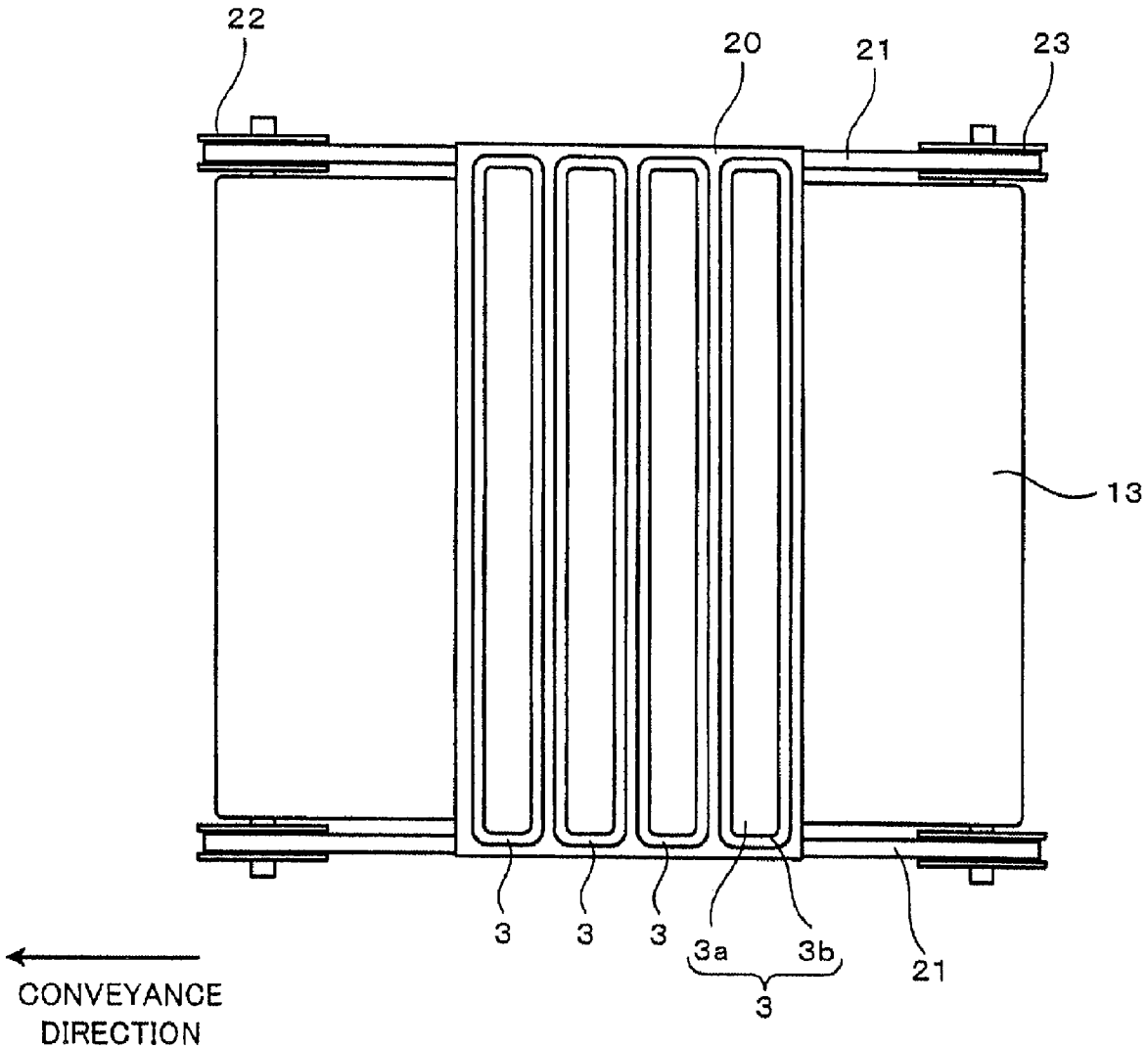
FIG. 3 is a bottom view of the ink-jet printer of FIG. 1.
Figure 4:
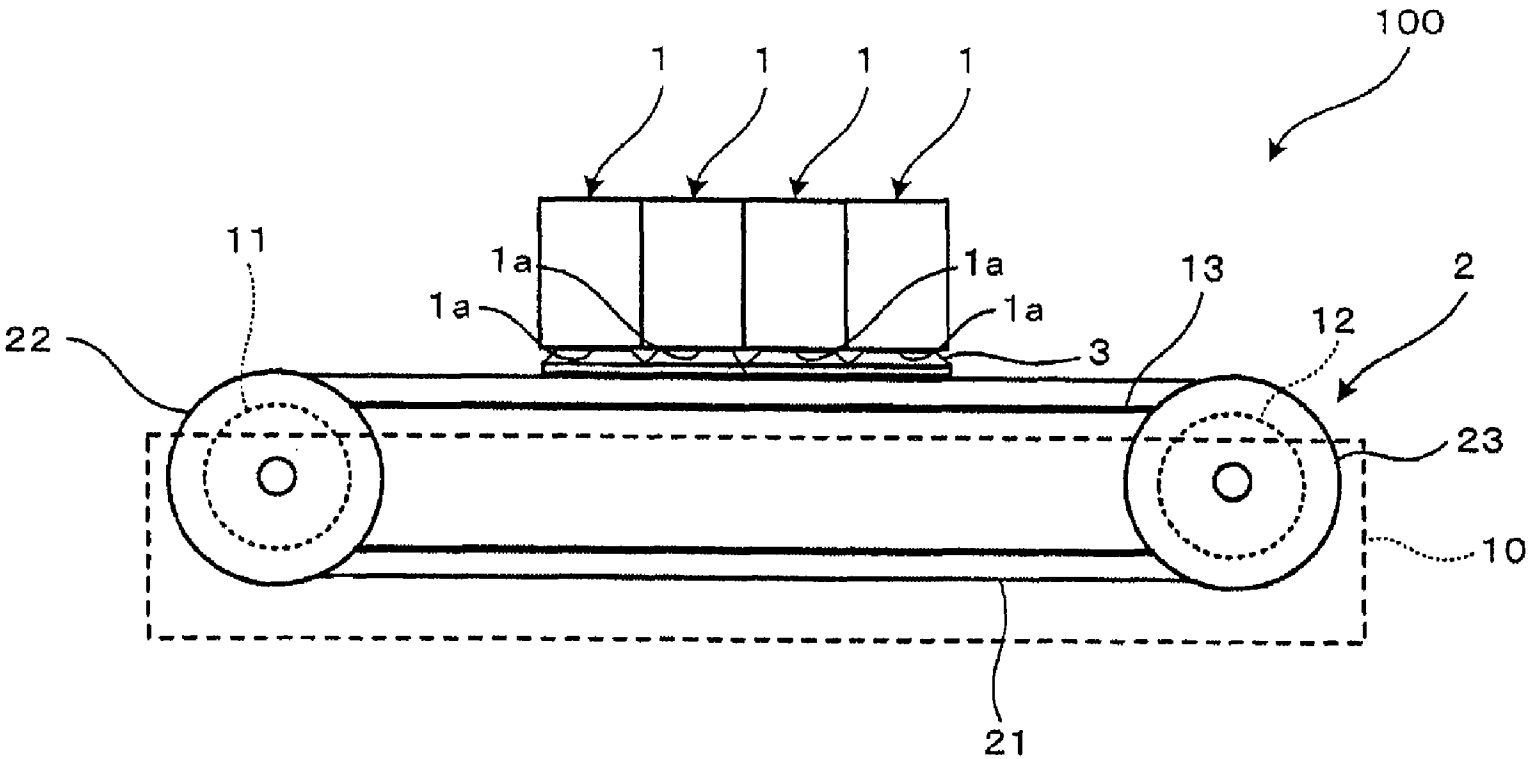
FIG. 4 schematically illustrates the ink-jet printer, while capping is being performed.

Next, the cap 3 will be described. When the ink-jet head 1 is not in use, the caps 3 cover the ink ejection faces 1*a* in order to prevent ink in the nozzles 8 from drying up. Each of the caps 3 is made of a flexible material such as a rubber material, and includes a base 3*a* and a lip 3*b* as shown in FIG. 3. A planar area of the base 3*a* is slightly larger than an area of the ink ejection face 1*a* where the nozzles 8 are arranged (see FIG. 2). The lip 3*b* has a shape of substantially rectangular frame that protrudes outward from an edge of the base 3*a*.

As shown in FIG. 1 and FIGS. 3 to 5, the four caps 3 are provided on an outer surface of a cap movement sheet 20, so as to neighbor each other in the conveyance direction. Both ends of the cap movement sheet 20 are connected to two belts 21, respectively. Each of the belts 21 is stretched between a drive pulley 22 and a slave pulley 23. The drive pulley 22 and the slave pulley 23 are disposed coaxially with the two rollers 11 and 12 having the conveyor belt 13 stretched therebetween, respectively. The drive pulley 22 and the slave pulley 23 can rotate relative to the two rollers 11 and 12, respectively. Accordingly, as shown in FIG. 1, by the drive pulley 22 driving the cap movement sheet 20, the four caps 3 can move at outside of the conveyor belt 13 along the outer surface of the belt 13, between a withdrawal position at which the caps 3 are not opposed to the ink ejection faces 1*a* of the ink-jet heads 1 (as in FIG. 1) and a capping position at which the caps 3 are opposed to the ink ejection faces 1*a* (as in FIG. 4). In addition, the caps 3 are movable integrally with the conveyance frame 10 in an up-and-down direction relative to the ink-jet heads 1, which means that the caps 3 are contactable with and separable from the ink ejection faces 1*a*.

The caps 3 perform a capping operation on the ink ejection faces 1*a* in the following manner. First, by an unillustrated elevator mechanism, the conveyance frame 10 is driven downward relative to the four ink-jet heads 1, to be away from the ink ejection faces 1*a*. Consequently, the clearance between the ink ejection faces 1*a* and the conveyor belt 13 becomes larger than in recording. The drive pulley 22 drives the caps 3 through the belts 21 so that the caps move along the outer surface of the conveyor belt 13 into the clearance. Thus, the caps 3 are disposed from the withdrawal position as in FIG. 1 into the capping position as in FIG. 4 at which the caps 3 are opposed to the ink ejection faces 1*a*. Then, the conveyance frame 10 is driven upward by an unillustrated elevator mechanism. At this time, the caps 3 moves upward integrally with the conveyance frame 10. Thus, the lip 3*b* of the cap 3 comes into close contact with a portion of the ink ejection face 1*a* surrounding a region where the ejection ports of the nozzles 8 are arranged, so that the ejection ports of the nozzles 8 are covered with the cap 3.

Next, the cleaning unit 4 will be described. The cleaning unit 4 wipes off extra ink adhering to the ink ejection face 1*a* after ink ejection, in order to always keep good ejection of ink from the respective nozzles 8. In addition, the cleaning unit 4 is adapted to clean the lip 3*b* of the cap 3 concurrently with wiping ink off the ink ejection face 1*a*.

As shown in FIGS. 5 to 9, the cleaning unit 4 includes a holder 30 as a mover, wipers 31, and cap cleaning blades 35 as a cap cleaner. The holder 30 is provided so as to, while adjacent to the ink ejection face 1*a*, move in parallel to the ink ejection face 1*a* along the longitudinal direction of the ink-jet head 1. The wipers 31 are provided so as to protrude from an upper face of the holder 30 upward, that is toward the ink ejection faces 1*a*. The cap cleaning blades 35 are provided so as to protrude from a lower face of the holder 30 downward, that is in a direction away from the ink ejection faces 1*a*.

Figure 5:
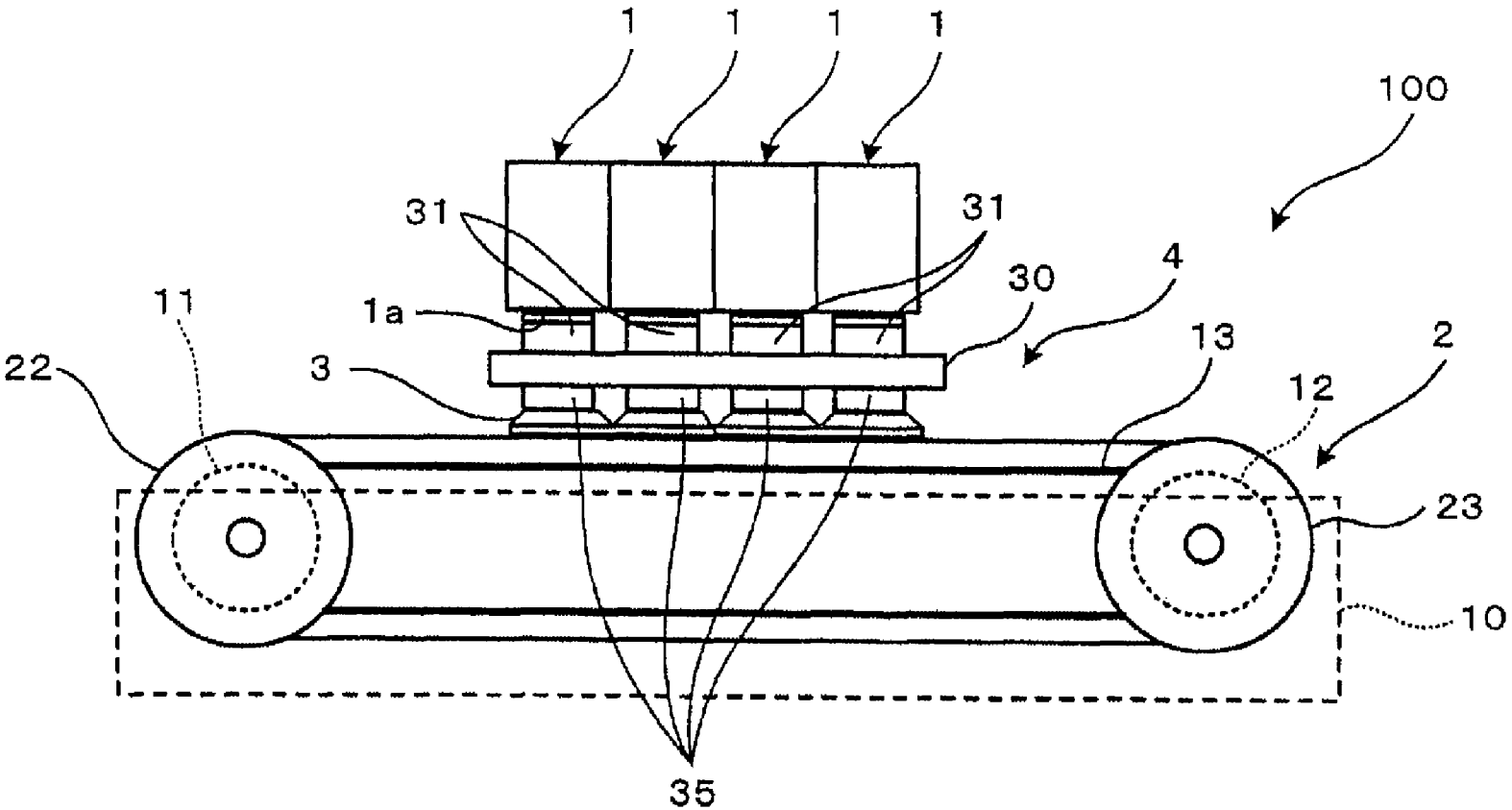
FIG. 5 schematically illustrates the ink-jet printer, while an ink ejection face and a cap are being cleaned.

As shown in FIG. 5, the holder 30 extends over widths of the four ink-jet heads 1. While the ink-jet heads 1 are in use, the holder 30 stands by at a standby position on one longitudinal side of the ink-jet heads 1 at a left side in FIG. 8, as illustrated with alternate long and two short dashes lines in FIG. 8. When performing wiping of the ink ejection face 1*a* by the wiper 31 and cleaning of the cap 3 by the cap cleaning blade 35, an unillustrated drive motor drives the holder 30 with the cap 3 being separated from the ink ejection face 1*a*, so that the holder 30 moves between the ink ejection face 1*a* and the cap 3, rightward in FIG. 8 from the standby position, as illustrated with a solid line in FIG. 8.

Figure 6A:
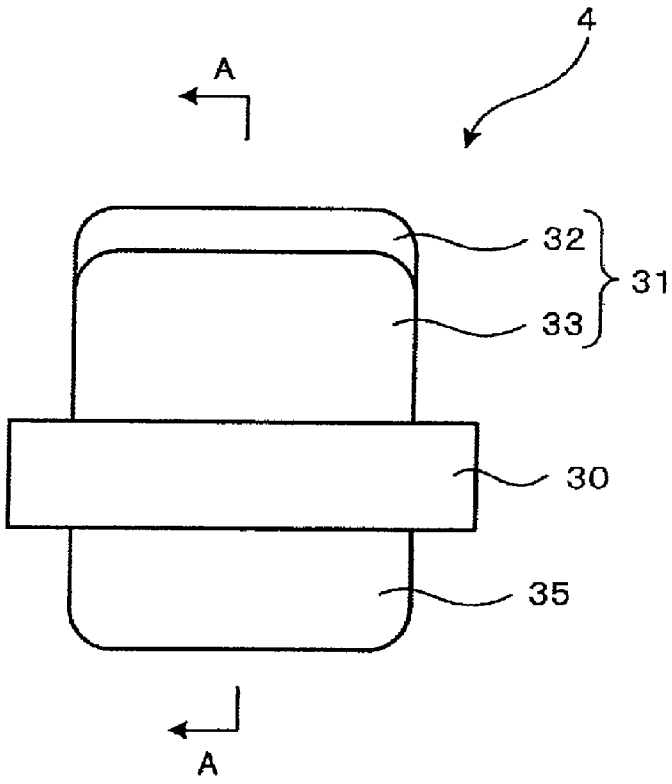
FIG. 6A shows a part of a cleaning unit on an enlarged scale.
Figure 6B:
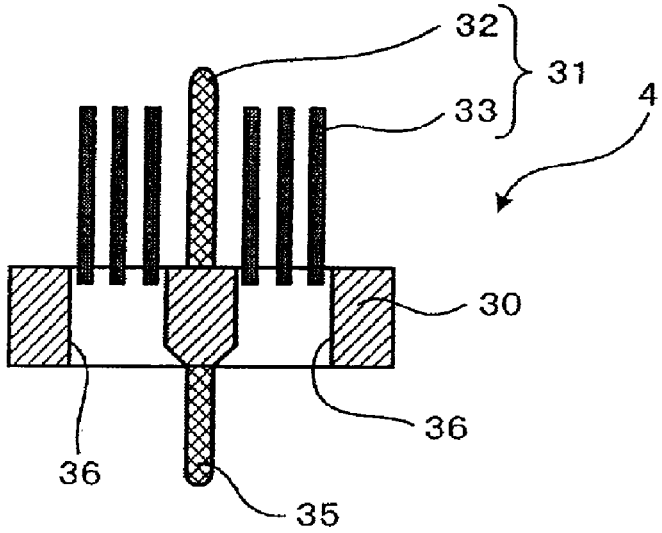
FIG. 6B is a sectional view as taken along line A-A in FIG. 6A.
Figure 8:
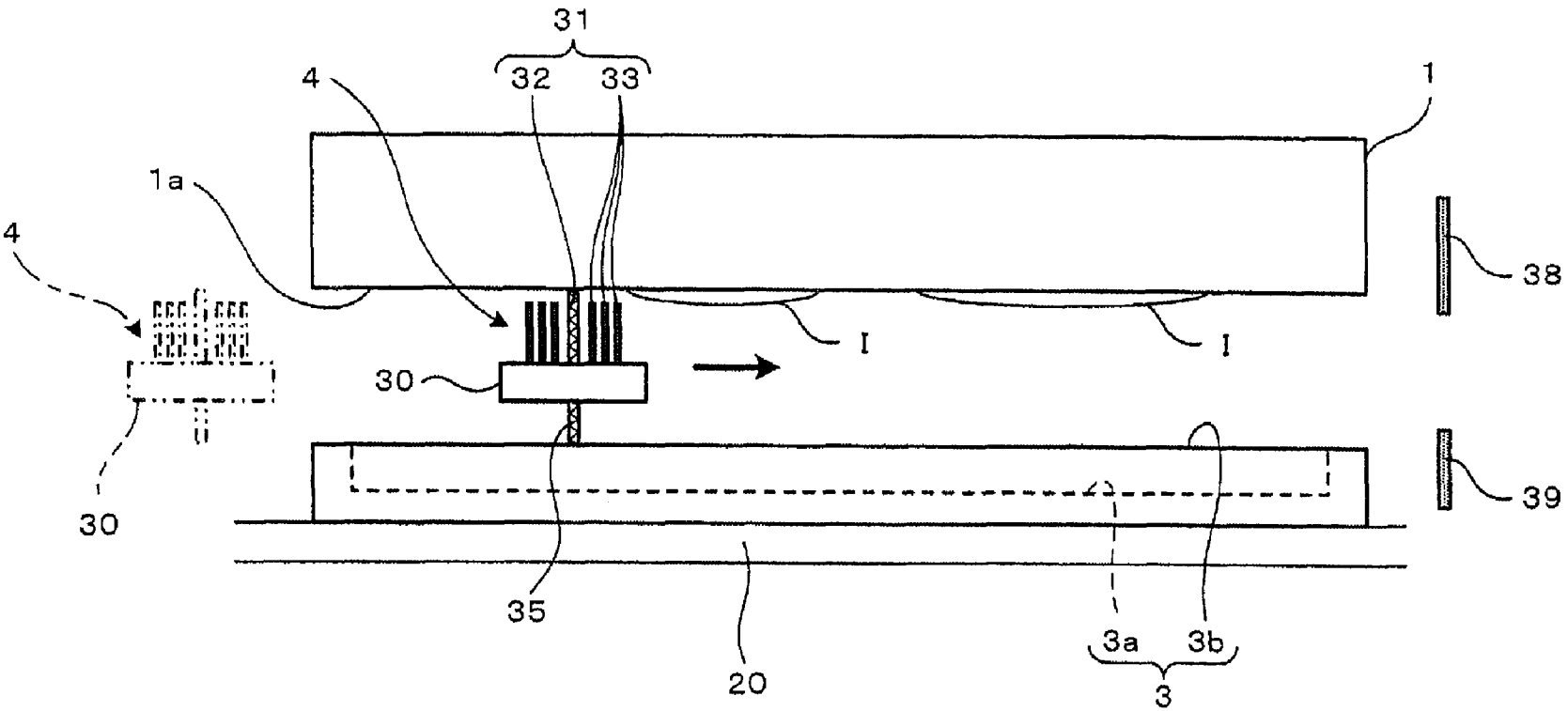
FIG. 8 shows a cleaning operation being performed by a wiper and the cap cleaning blade.

As shown in FIG. 5, four wipers 31 corresponding to the four ink-jet heads 1 are provided on the upper face of the holder 30. As shown in FIGS. 6A and 6B, each of the wipers 31 includes a wiper blade 32 as a first wiping member and plate members 33 as second wiping members. The wiper blade 32 is provided at a central portion of the holder 30 with respect to a horizontal direction in FIG. 6B. The number of the plate members 33 is six for example. The plate members 33 extend upward on both right and left sides of the wiper blade 32 in FIG. 6B, and are disposed in parallel to each other like a comb. Each of the wiper blade 32 and the plate members 33 is made of a flexible material such as urethane rubber having ink resistance. As shown in FIGS. 6 and 8, a protruding length of the wiper blade 32 is such that, when the holder 30 moves between the ink ejection face 1*a* and the cap 3, its end comes into contact with the ink ejection face 1*a*. On the other hand, a protruding length the plate members 33 is shorter than that of the wiper blade 32. Ends of the plate members 33 are spaced from the ink ejection face 1*a* at a very small distance and thus not in contact with the ink ejection face 1*a*.

Figure 9:
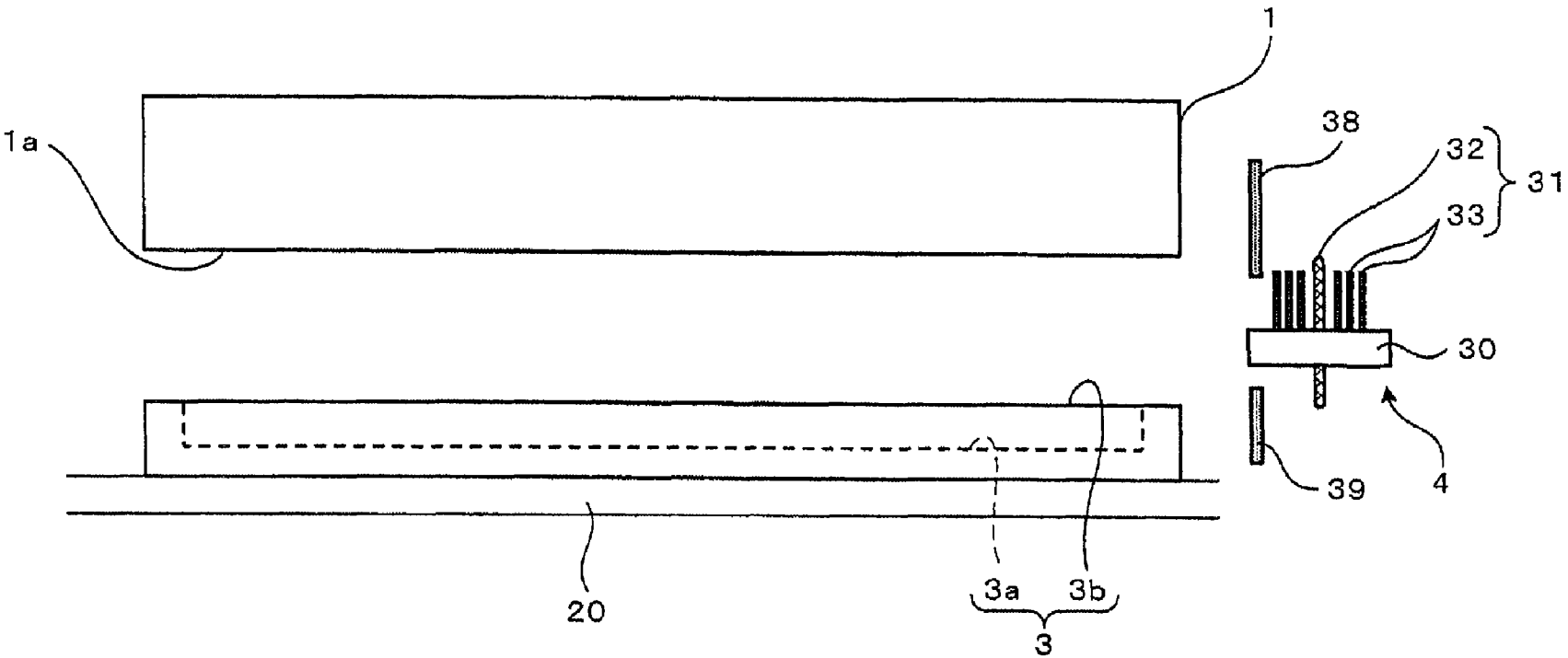
FIG. 9 shows a state where cleaning performed on the ink ejection face and the lip has been completed.

As shown in FIGS. 8 and 9, when the holder 30 moves from the standby position rightward with relatively large drops of ink I being adhering to the ink ejection face 1*a*, most of the ink I adhering to the ink ejection face 1*a* is firstly wiped off by the plate members 33 disposed on the right side, that is downstream in a direction of movement, of the wiper blade 32, and absorbed into between the plate members 33 due to capillary force. Then, ink remaining on the ink ejection face 1*a* is wiped off by the wiper blade 32 that is moving while in contact with the ink ejection face 1*a*.

Figure 7:
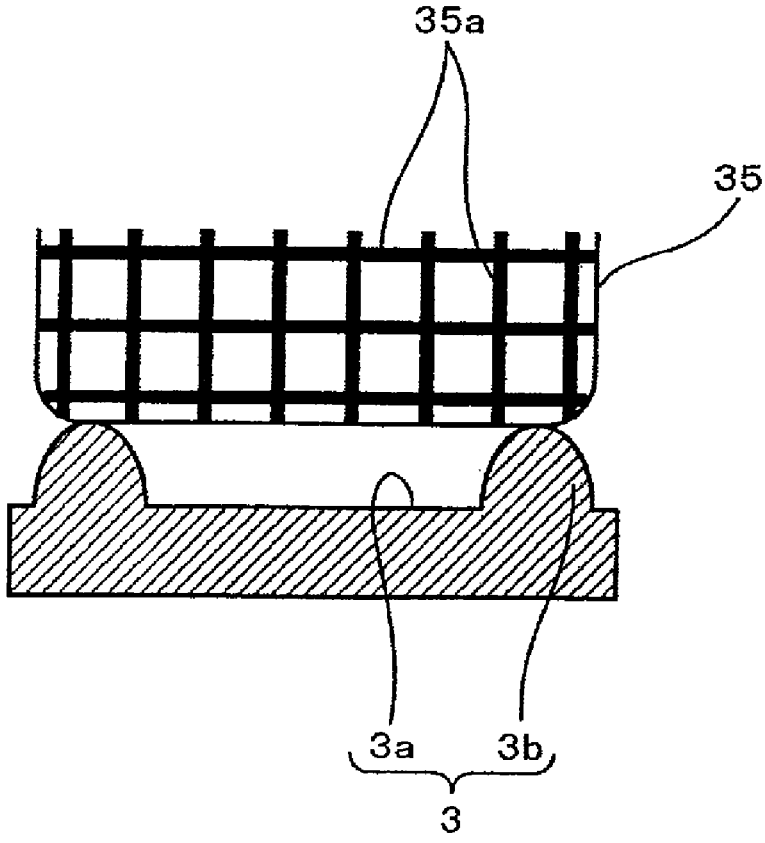
FIG. 7 shows a contact condition between a cap cleaning blade and a lip.

As shown in FIG. 5, four cap cleaning blades 35 corresponding to the four ink-jet heads 1 are provided on the lower face of the holder 30. As shown in FIG. 6, each of the cap cleaning blade 35 extends downward in a direction away from the wiper blade 32 from the lower face of the holder 30. Like the wiper 31, the cap cleaning blade 35 is made of a flexible material such as urethane rubber having ink resistance, too. As shown in FIG. 7, grooves 35*a* are formed in a grid pattern throughout a surface of the cap cleaning blade 35.

As shown in FIG. 8, a protruding length of the cap cleaning blade 35 is such that, when the holder 30 moves between the ink ejection face 1*a* and the cap 3, its end comes into contact with the lip 3*b* of the cap 3. As shown in FIGS. 8 and 9, when the holder 30 moves rightward from the standby position, the cap cleaning blade 35 moves integrally with the holder 30 and the wiper 31, with its end being kept in contact with the lip 3*b* (see FIG. 7). That is, in association with rightward movement of the wiper 31 relative to the ink ejection face 1*a*, the cap cleaning blade 35 cleans the lip 3*b*.

As described, the cleaning unit 4 of this embodiment is adapted to clean the lip 3*b* by means of the cap cleaning blade 35 concurrently with wiping off ink adhering to the ink ejection face 1*a* by means of the wiper 31. Accordingly, wiping ink off the ink ejection face 1*a* by means of the wiper 31, and cleaning the lip 3*b* by means of the cap cleaning blade 35 are performed concurrently. Therefore, these operations can be performed for a shorter period of time.

Here, as shown in FIG. 6B, two ink passage holes 36 are formed through the holder 30 from the upper face of the holder 30 which faces the ink ejection face 1*a* to the lower face of the holder 30 which faces opposite to the ink ejection face 1*a*. Ink wiped off by the wiper 31 passes through the two ink passage holes 36, and is supplied to the cap cleaning blade 35 that is disposed under the wiper 31. Thus, the cap cleaning blade 35 cleans the lip 3*b* of the cap 3 while wetting the lip 3*b* with the ink. Therefore, foreign materials such as dust and paper powder adhering to the lip 3*b* can be removed reliably.

As shown in FIG. 6B, the two ink passage holes 36 are formed on both sides of the central portion of the holder 30 at which the wiper blade 32 and the cap cleaning blade 35 are provided. The lower ends of the plate members 33 disposed on both sides of the wiper blade 32 are connected to the ink passage holes 36. That is, spaces formed between the plate members 33 communicate with the ink passage holes 36. A wall face of each of the two ink passage holes 36 is, at a lower end portion thereof, sloped toward the central portion of the holder 30, so as to form a smooth continuation with an upper end of the cap cleaning blade 35. This can ensure that ink wiped off by the wiper 31 and flowing to between the plate members 33 passes through the two ink passage holes 36 and is supplied to the cap cleaning blade 35.

As shown in FIG. 7, the grooves 35*a* are formed in a grid pattern throughout the surface of the cap cleaning blade 35. This allows ink to spread through the grooves 35*a* over the entire surface of the cap cleaning blade 35, and therefore the lip 3*b* can be surely wetted with ink.

As shown in FIGS. 8 and 9, upper and lower two cleaning members 38 and 39 as a cleaning mechanism that clean the wiper 31 and the cap cleaning blade 35, respectively, are provided at a right side so as to be opposite to the standby position across the ink-jet head 1. The upper cleaning member 38 has its lower end positioned lower than upper ends of the wiper blade 32 and the plate members 33 that constitute the wiper 31. The lower cleaning member 39 has its upper end positioned higher than a lower end of the cap cleaning blade 35. Thus, as shown in FIG. 9, when the holder 30 moves more rightward and passes between the upper and lower two cleaning members 38 and 39 after the wiper 31 wipes ink off the ink ejection face 1*a* and the cap cleaning blade 35 cleans the lip 3*b*, the upper cleaning member 38 removes foreign materials adhering to the wiper blade 32 and the plate members 33 while the lower cleaning member 39 removes foreign materials adhering to the cap cleaning blade 35. As a result, foreign materials wiped off by the wiper 31 and the cap cleaning blade 35 are prevented from re-adhering to the ink ejection face 1*a* or the lip 3*b* of the cap 3.

Next, various modifications of the above-described embodiment will be described. Here, the same constructions as in the above-described embodiment will be denoted by the common reference characters, and descriptions thereof will be appropriately omitted.

[1]In the above-described embodiment, the holder 30 stands by at the standby position which locates on one longitudinal end of the ink-jet head 1 while the ink-jet head 1 is performing recording, and moves toward the other longitudinal end of the ink-jet head 1, for cleaning the ink ejection face 1*a* and the cap 3 (see FIG. 8). However, the holder 30 may stand by at two standby positions which locate on both longitudinal ends of the ink-jet heads 1.

Figure 10:
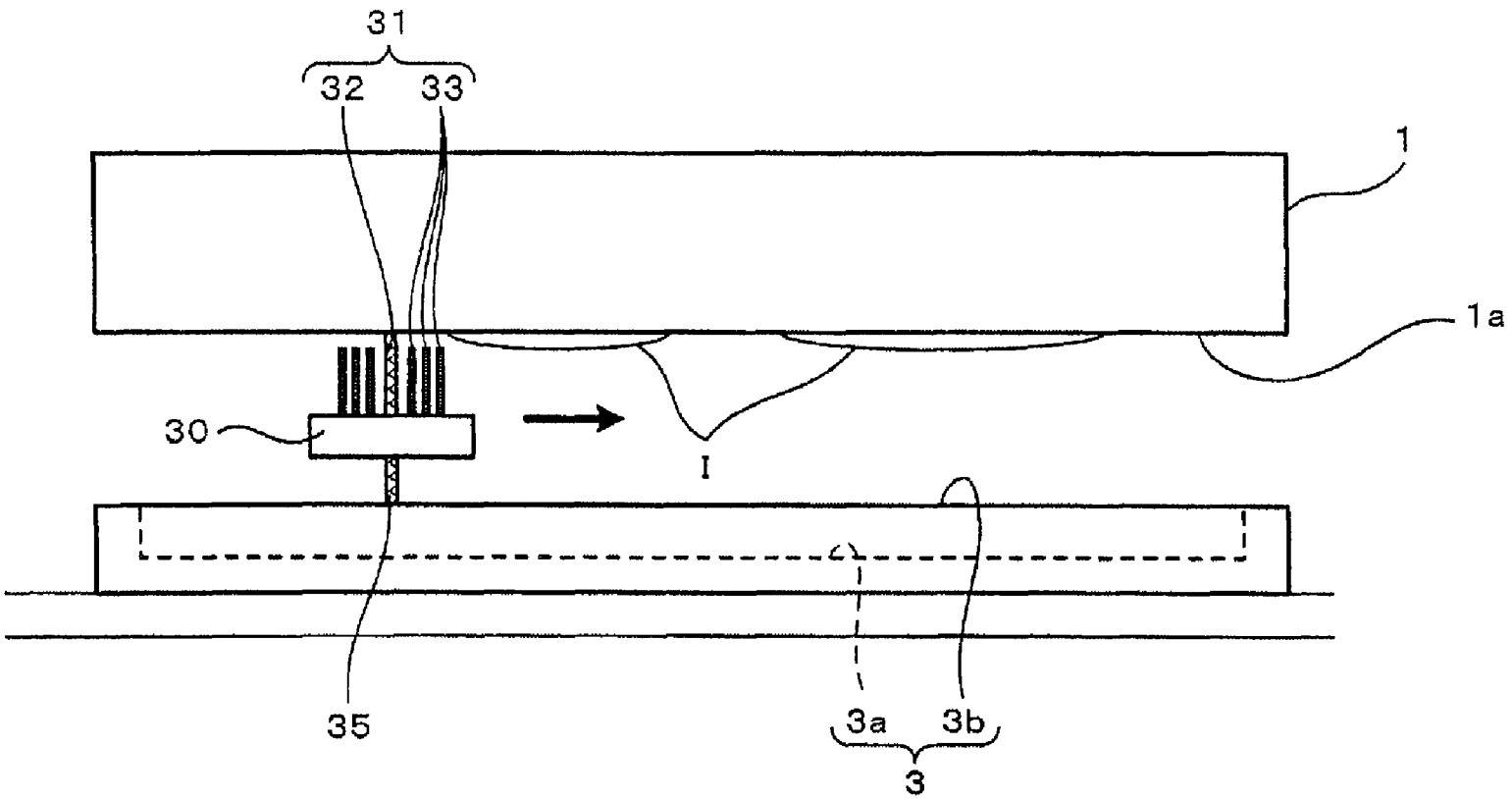
FIG. 10 shows a cleaning operation being performed by a wiper and a cap cleaning blade according to a modification, while a holder is moving in one direction.
Figure 11:
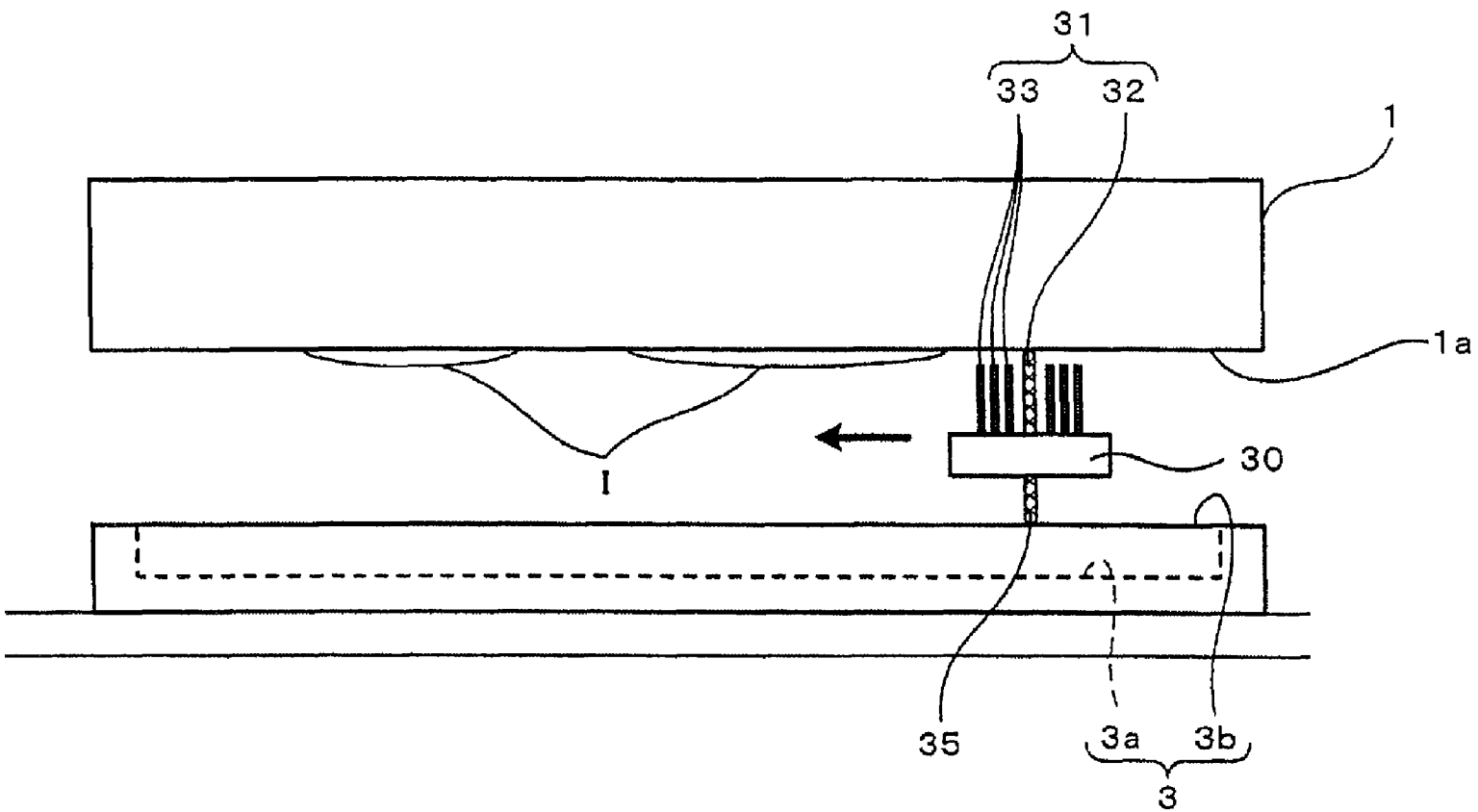
FIG. 11 shows a cleaning operation being performed by the wiper and the cap cleaning blade, while a holder is moving in the other direction.

That is, as shown in FIG. 10, in a case where the holder 30 is in a standby position on a left side of the ink-jet head 1, the holder 30 moves rightward so that the wiper 31 wipes ink I off the ink ejection face 1*a* and the cap cleaning blade 35 cleans the lip 3*b*. On the other hand, as shown in FIG. 11, in a case where the holder 30 is in a standby position on a right side of the ink-jet head 1, the holder 30 moves leftward so that the wiper 31 wipes ink I off the ink ejection face 1*a* and the cap cleaning blade 35 cleans the lip 3*b*. With this construction, it is not necessary to return the holder 30 to the standby position on one side of the ink-jet head 1 every time before cleaning the ink ejection face 1*a* and the cap 3. As a result, the ink ejection face 1*a* and the cap 3 can be cleaned for a further shorter period of time.

[2]In the above-described embodiment, during movement of the holder 30 in the longitudinal direction of the ink-jet head 1, wiping ink off the ink ejection face 1*a* by means of the wiper 31 and cleaning the cap 3 by means of the cap cleaning blade 35 are performed concurrently (see FIG. 8). However, it takes some time for ink wiped off the ink ejection face 1*a* by the wiper 31 to reach a surface of the cap cleaning blade 35. Accordingly, immediately after the cap cleaning blade 35 start cleaning the lip 3*b*, the lip 3*b* may be wiped without sufficient ink being supplied thereto. In view of this, it may be possible that the wiper 31 precedingly wipes ink off the ink ejection face 1*a* and the cap cleaning blade 35 does not clean the cap 3 until ink thus wiped off is supplied to the cap cleaning blade 35.

Figure 12:
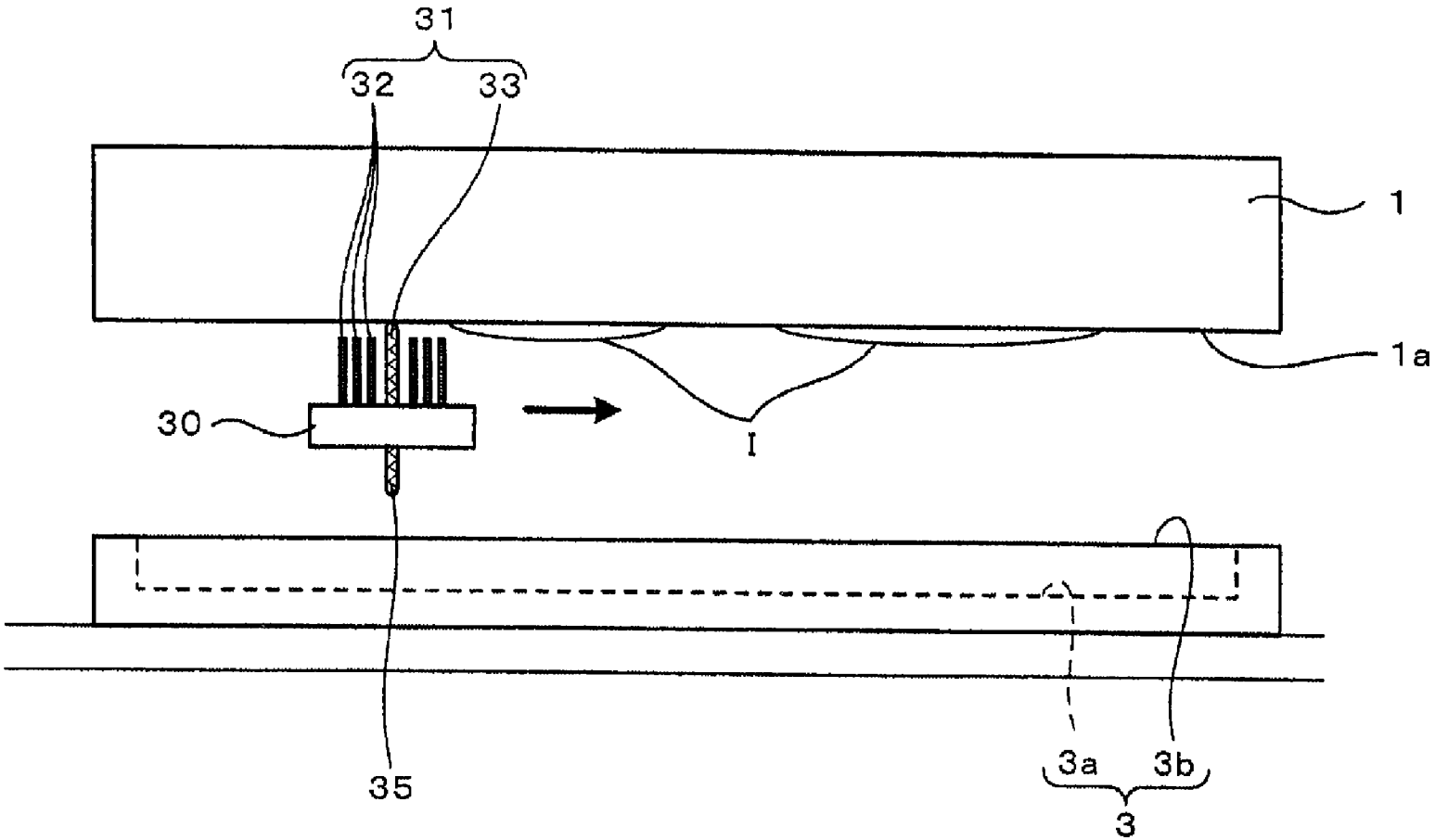
FIG. 12 shows a cleaning operation being performed on an ink ejection face by a wiper, according to another modification.

An example of such a construction will be described below. In FIG. 12, first, the holder 30 can move in an up-and-down direction relative to the ink-jet head 1 and the cap 3. In a state where the wiper blade 32 mounted on the holder 30 has its upper end kept in contact with the ink ejection face 1*a,* the holder 30 moves from left to right in FIG. 12 so that the wiper 31 wipes off ink I adhering to the ink ejection face 1*a.* At this time, an end of the cap cleaning blade 35 is not in contact with the lip 3*b* of the cap 3 which is therefore not cleaned.

Figure 13:
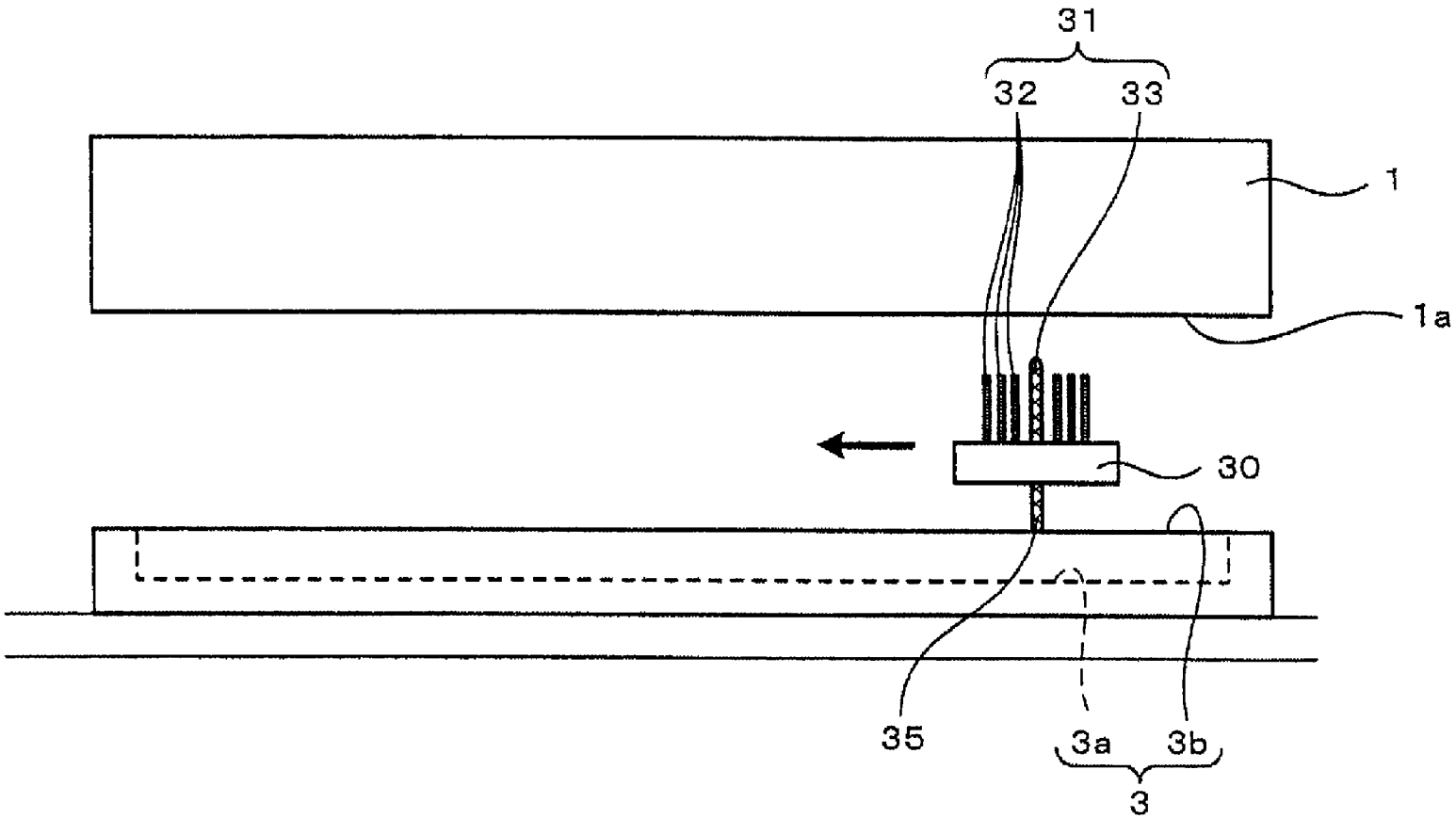
FIG. 13 shows a cleaning operation being performed on a lip by a cap cleaning blade.

When the holder 30 reaches a position at a right side of the ink-jet head 1, the holder 30 then moves downward relative to the ink-jet head 1 and the cap 3. Thus, as shown in FIG. 13, the end of the wiper blade 32 mounted on the holder 30 is positioned lower than the ink ejection face 1*a,* while the end of the cap cleaning blade 35 comes into such a position that it can contact the lip 3*b* of the cap 3. In this state, ink wiped off by the wiper 31 has already been supplied to the cap cleaning blade 35, because a certain period of time has elapsed since the wiper 31 wipes ink off the ink ejection face 1*a.* Accordingly, when under this state the holder 30 moves from right to left, the cap cleaning blade: 35 can clean the lip 3*b* while sufficiently wetting the lip 3*b* with ink. At this time, the end of the wiper blade 32 is out of contact with the ink ejection face 1*a.* Therefore, the ink ejection face 1*a* from which ink has already been wiped off is not re-wiped, and thus the ink ejection face 1*a* is not damaged.

[3]Constructions of the parts of the cleaning unit are not limited to the above-described ones, but various modifications can be made. For example, referring to FIG. 6 showing the above-described embodiment, the number of plate members 33 neighboring the wiper blade 32 may not necessarily be two or more, but it may be one. In such a case as well, ink wiped off by the plate member 33 flows through a lower end of the plate member 33 into the ink passage hole 36, so that the ink is supplied through the ink passage hole 36 to the cap cleaning blade 35. Moreover, the plate member 33 may be omitted. In such a case, ink wiped off by the wiper blade 32 is supplied through the ink passage hole 36 to the cap cleaning blade 35.

Figure 14B:
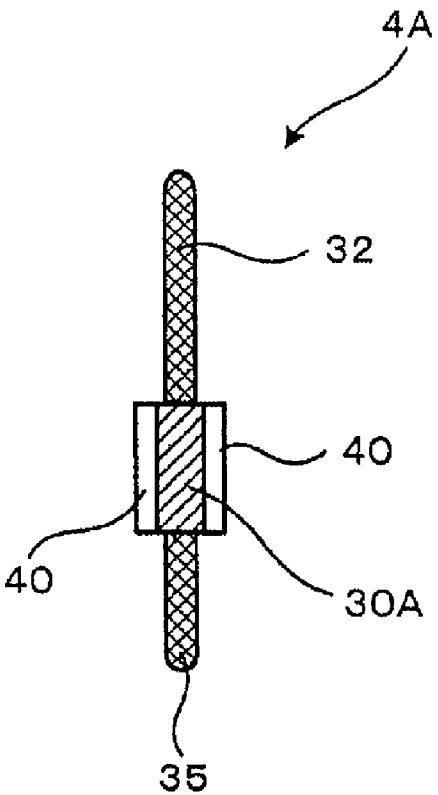
FIG. 14B is a sectional view as taken along line B-B in FIG. 14A.
Figure 14A:
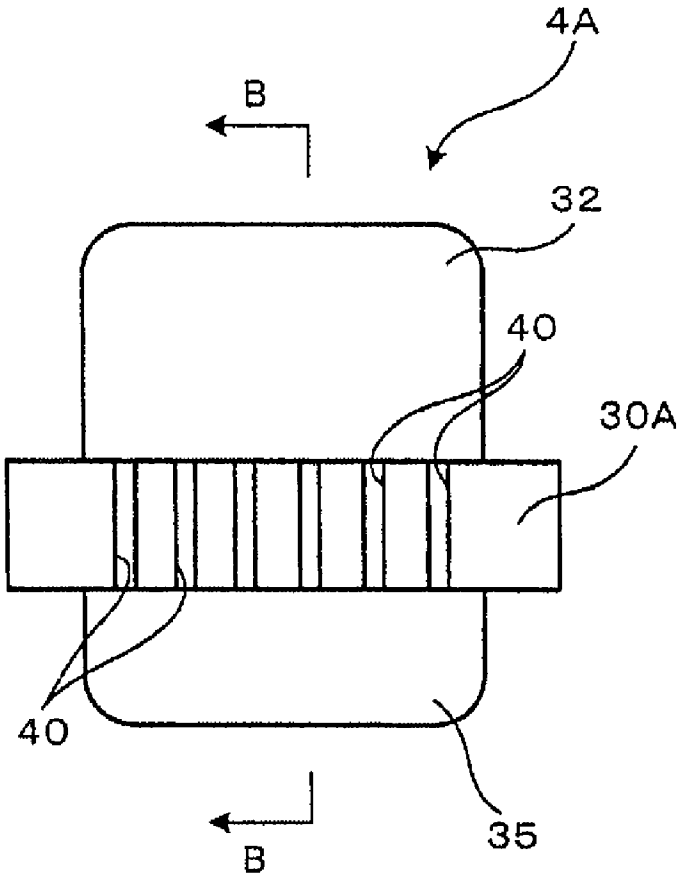
FIG. 14A shows a cleaning unit according to still another modification.

As an ink supplier that supplies ink from the wiper 31 to the cap cleaning blade 35, various constructions other than the holder 30 as in the above-described embodiment can be adopted. For example, it may be possible that, as shown in FIGS. 14A and 14B, grooves 40 extending in an up-and-down direction are formed on both side faces of a holder 30A of a cleaning unit 4A in such a manner that a lower end of the wiper blade 32 and an upper end of the cap cleaning blade 35 are connected to grooves 40. With this construction, ink wiped off by the wiper blade 32 is supplied through the grooves 40 to the cap cleaning blade 35. Here, the grooves 40 may be formed on only one side face of the holder 30A. In addition, it may not be necessary that several grooves 40 are formed, but only one groove 40 may be acceptable, too.

[5]The cap cleaner that cleans the lip 3*b* of the cap 3 is not limited to the cap cleaning blade 35 of the above-described embodiment. A shape, a material, and the like may be changed appropriately. For example, it may have a shape other than a blade or plate shape, such as a substantially rectangular parallelepiped block shape, a hemispherical shape, and the like. In addition, it is not particularly necessary that four cap cleaners are provided for the respective four caps 3. The cap cleaner may be shared by the four caps 3.

The cap cleaner may be made of a material that can absorb ink, such as a sponge. In this case, the cap cleaner can hold some ink by itself. Accordingly, for a certain period of time, even without ink supply from the wiper 31, the cap cleaner can clean the lip 3*b* while wetting the lip 3*b* with its own ink. Therefore, it is not necessary that a timing of cleaning the lip 3*b* by the cap cleaner is adjusted to a timing of wiping the ink ejection face 1*a* by the wiper 31.

[6]In the above-described embodiment, for cleaning the ink ejection face 1*a* and the cap 3, the wiper 31 and the cap cleaning blade 35 move in the longitudinal direction of the head relative to the line-type ink-jet head 1 and the cap 3. However, it may also be possible that, in order to clean the ink ejection face 1*a* and the cap 3, the ink-jet head 1 and the cap 3 move in the longitudinal direction of the head relative to a wiper and a cap cleaner provided fixedly.

[7]The above-described embodiment illustrates an example of application of the present invention to an ink-jet printer including a cap that prevents nozzles from drying up. However, the present invention is applicable also to an ink-jet printer including a purge cap that covers an ink ejection face while nozzle purge is being performed. That is, an ink-jet printer may be adapted to purge nozzles by forcibly ejecting ink through the nozzles while covering an ink ejection face with a purge cap, and then use a wiper to wipe off ink adhering to the ink ejection face as a result of the nozzle purge and at the same time use a cap cleaner to clean a lip of the purge cap while wetting the lip with ink thus wiped off.

The nozzle purge includes two methods of suction purge and positive pressure purge. In the suction purge, ink contained in nozzles is forcibly sucked from a cap side. In the positive pressure purge, pressure is applied to ink from an upstream of nozzles thereby forcibly discharging ink from the nozzles into a cap. Particularly in the positive pressure purge, a less amount of ink is discharged than in the suction purge, and therefore a lip of a purge cap easily dries after purge. Hence, the present invention is most preferably applied to an ink-jet printer that performs such positive pressure purge.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet printer comprising:

an ink-jet head that ejects ink;

a cap that is contactable with and separable from an ink ejection face of the ink-jet head, and includes a lip brought into close contact with the ink ejection face;

a wiper that is movable in parallel to and relative to the ink ejection face, and wipes off ink adhering to the ink ejection face;

a cap cleaner that is provided integrally with the wiper, and, while being in contact with the lip, cleans the lip in association with the wiper moving relative to the ink ejection face; and an ink supplier that supplies ink wiped off by the wiper to the cap cleaner.

2. The ink-jet printer according to claim 1, wherein, when the wiper wipes off ink adhering to the ink ejection face, the cap cleaner concurrently cleans the lip.

3. The ink-jet printer according to claim 1, wherein, after the wiper wipes off ink adhering to the ink ejection face, the cap cleaner cleans the lip.

4. The ink-jet printer according to claim 1, wherein the ink supplier includes a mover that is movable in parallel to the ink ejection face while being adjacent to the ink ejection face; and the wiper is provided on the mover so as to protrude toward the ink ejection face, and the cap cleaner is provided on the mover so as to protrude in a direction away from the ink ejection face.

5. The ink-jet printer according to claim 4, wherein the ink supplier has an ink passage hole that is formed through the mover and is extending along a direction from the ink ejection face to the mover.

6. The ink-jet printer according to claim 5, wherein:

the wiper includes a first wiping member that protrudes from the mover to the ink ejection face, and a plate-shaped second wiping member that protrudes from the mover to the ink ejection face with its protruding length from the mover being shorter than that of the first wiping member; and the lower end of the second wiping member is connected to the ink passage hole.

7. The ink-jet printer according to claim 6, wherein a plurality of the second wiping members arranged in parallel to each other are provided on the mover, and a space formed between the plurality of the second wiping members communicates with the ink passage hole.

8. The ink-jet printer according to claim 1, wherein a groove is formed in a grid pattern throughout a surface of the cap cleaner.

9. The ink-jet printer according to claim 1, further comprising a cleaning mechanism that cleans the wiper and the cap cleaner after the wiper wipes ink off the ink ejection face and the cap cleaner cleans the lip.

10. The ink-jet printer according to claim 1, wherein:

the ink-jet head is a line-type ink-jet head elongated in a predetermined direction;

the cap is disposed so as to be opposed to the ink ejection face of the ink-jet head; and the wiper and the cap cleaner are movable between the ink ejection face and the cap in the predetermined direction when the cap is spaced from the ink ejection face.

* * * * *